United States Patent [19]

Sturm et al.

[11] Patent Number: 5,033,207

[45] Date of Patent: Jul. 23, 1991

[54] DEVICE FOR DRYING A MATERIAL WEB

[75] Inventors: Wolfram Sturm; Wolfgang Mayer, both of Heidenheim, Fed. Rep. of Germany

[73] Assignee: J.M. Voith GmbH, Heidenheim, Fed. Rep. of Germany

[21] Appl. No.: 547,975

[22] Filed: Jul. 3, 1990

[30] Foreign Application Priority Data

Jul. 7, 1989 [DE] Fed. Rep. of Germany ..... 3922361
May 25, 1990 [DE] Fed. Rep. of Germany ..... 4016921

[51] Int. Cl.[5] ..... F26B 11/02
[52] U.S. Cl. ..... 34/115; 34/117
[58] Field of Search ..... 34/115, 116, 114, 117, 34/122, 123; 162/202

[56] References Cited

U.S. PATENT DOCUMENTS 4,856,205 8/1989 Meyer et al. ..... 34/117
4,881,327 11/1989 Hauser et al. ..... 34/114

FOREIGN PATENT DOCUMENTS 1255920 9/1969 United Kingdom .

*Primary Examiner*—Henry A. Bennett
*Attorney, Agent, or Firm*—Jeffers, Hoffman & Niewyk

[57] ABSTRACT

A material web to be dried runs across a first drying cylinder onto which it is forced by a concurrently running continuous drying wire. Thereafter, the web and the drying wire proceed jointly from the first drying cylinder to a suction guide roll. From the latter, at least the drying wire returns to another drying cylinder. This path of the drying wire defines a wire space S. Blown into this wire space, for instance by means of a blow pipe, is drying air at uniform distribution across the machine width and sucked out again by the suction guide roll. This suction air is blown at the material web by means of a circulation air fan, at the circumference of the suction guide roll, and is sucked away again from there by means of an exhaust air fan.

25 Claims, 5 Drawing Sheets

44
47
46
45
40
43
42
41
61
48
62
11
S
12
10
13
22
63
51"
65
71
64
11a
10a
12a
S'
50
49

44
68
47
46
45
40
67
43
42
41
63b
75
63a
66
61
62
48
20
11
10
62
13
38'
12
38
39
9
30a
S
S
63
30
x
78
22
23
21
51
51
21a
22a
64
63
64
50
49
63
63a 44
68
47
46
45
40
76
43
42
41
b
63b
72
a
63
a
71
63a
77
b
61
62
62
48
20
11
10
12
13
38'
38
39
9
30a
S
S
63
x
30
78
21
21a
51
22
22a
51
23
64
63
64
50
49
63
63a

DEVICE FOR DRYING A MATERIAL WEB

BACKGROUND OF THE INVENTION

The invention concerns a device for drying a material web, specifically paper or cardboard web, of the general type in which a suction guide roll that features a suction device is arranged between two drying cylinders in a row of heatable drying cylinders contacted by the material web. A porous backing belt, preferably a drying wire, runs with the material web through the drying device. The backing belt forces the material web on the drying cylinders and makes direct contact with the suction guide rolls, wherein two adjacent drying cylinders, the suction guide roll arranged in between, and the backing belt define a so-called "wire space". An air guide box is provided on the path of the material web from one of the drying cylinders to the next drying cylinder for feeding drying air directly at the material web by means of a fan featuring a suction line.

Regarding the prior art, reference is made to the Voith patent applications P 38 07 856.2 and P 38 07 857.0. The former application concerns a so-called single-wire drying group. In it, the material web to be dried runs together with a backing belt (preferably drying wire) alternately across heatable drying cylinders and suction guide rolls. In the process, the material web makes direct contact with the drying cylinders, while the backing belt makes direct contact with the suction guide rolls. On its entire path through the drying device the material web is guided by the backing belt, so that the material web must at no point, or at the most at the exit from the drying device, run freely from one roll to another.

The object of the second patent application P 38 07 857.0 is a two-wire drying group. In this group, the material web to be dried meanders alternately across drying cylinders of an upper cylinder row and across drying cylinders of a lower cylinder row. The material web is forced on the upper drying cylinder by an upper backing belt and on the lower drying cylinders by a lower backing belt. Along part of its path between two drying cylinders, the paper web is free, that is, it is not supported by a backing belt.

Common to both configurations is that the material web and the backing belt run jointly from a first drying cylinder to a guide roll looped by the backing belt, whereafter the backing belt runs from this guide roll to another drying cylinder (with the object of the application P 38 07 856.2 the guide roll is fashioned as a suction guide roll). Common to both, additionally, is that the two previously mentioned drying cylinders and the guide roll arranged in between as well as the backing belt define a so-called "wire space." Lastly, common to both is also that for purposes of increasing the specific drying performance at the point where the material web runs from one drying cylinder to the next drying cylinder there is drying air blown directly at the material web. This air absorbs at that point water vapor from the material web. A maximum quantity of this air is directly sucked off as exhaust air. To influence the moisture cross profile of the material web, the supplied drying air flow can, across the width of the material web, be subdivided into individually controllable partial flows.

Although the described measures already permit the expectation of an increased drying performance, additional improvements are desirable. So far, attempts have been made at achieving further improvements, among others, by increasing the exhaust temperature and thus raising the dew point of the exhaust air, additionally by increasing the volumes of supply and exhaust air. However, these measures increase the energy consumption for drying. Besides, there is a risk of creating in the drying device uncontrolled flows of moist exhaust air and that the water vapor will condense on the side or upper walls of the hood, requiring a heavier thermal insulation on the hood walls.

Therefore, the problem underlying the invention is to improve the previously proposed device to the effect that uncontrolled flows of moist air within the drying device will be avoided with greater certainty than heretofore. At the same time, the energy consumption for the drying is to be kept maximally low.

SUMMARY OF THE INVENTION

This problem is solved by the features set forth in the present invention. Coordinated with each of the described wire spaces is a blow box, which extends crosswise through the drying device and features at least one row of blowing air orifices extending across the box length and directed into the wire space. The suction side of a fan is connected to the suction device of the suction guide roll, for instance by means of a so-called circulation air line.

According to an embodiment of the invention, a first inventional idea is constituted by the fact that for boosting the drying performance drying air is as so-called supply air fed to the individual wire space by means of a blow box, in uniform distribution across the machine width. A similar type of drying air supply is known already known from the British patent document 1,255,920. However, this air escapes in uncontrolled fashion upward and sideways, along with absorbed water vapor, giving rise again to the risk that water vapor will condense on the hood walls. Inventionally, the air supplied to the wire space is therefore sucked out of the wire space again in uniform distribution across the machine width, for instance through the respective suction guide roll. In this way, clouds accruing in the area of the wire space, such as water vapor issuing from the material web, will be removed specifically at the site of their generation. In other words, this measure avoids a situation wherein drying air having absorbed water vapor will in transverse direction flow out of the wire space or escape upward in uncontrolled fashion. Thus, a situation is avoided wherein this air will sweep across fixed side or upper components, for instance across the hood walls, uprights or similar, and that the water vapor condenses on the components. This makes it possible to avoid a heavier thermal insulation of the hood, whereby insulation may be designed even lighter than before. Additionally it becomes possible to use drying air with a relatively high temperature ,and thus a relatively high dew point, for ventilation of the wire spaces, so that relatively limited volumes of supply air will be needed. This reduces in many cases the required supply air volume.

On the other hand, in the case of a single-wire drying group, for achieving a stable web run it is necessary, in view of the desired high web speeds on the order of 1600 m/min, to operate the suction guide rolls at a relatively high vacuum and, therefore, suck off relatively large air volumes from the suction guide rolls. These air quantities are generally greater than necessary for removal of the water vapor accruing in the wire spaces. Therefore, another important inventional idea provides, to increase the economy of the drying device, for utilizing the air sucked out of the wire space a second time for removal of water vapor. This is accomplished in that the said air is blown, as so-called circulating air, directly at the material web at the point where the largest water vapor share issues from the material web (principal evaporation). This is the area where the material web runs from one of the drying cylinders to the next.

According to an embodiment of the present invention, this is achieved in that the suction line of the blower which feeds drying air directly to the material web is connected to the suction device(s) of the suction guide roll(s). Achieved in this way is a considerable additional increase of the drying performance, and at the same time favorable values for the entire energy consumption.

As in the initially mentioned drying devices, this blowing air at the material web is combined with sucking the air laden with water vapor off again, thus also avoiding also uncontrolled flows of exhaust air. Thus, an important characteristic of the invention is that the drying air is successively given twice the opportunity to absorb water vapor, namely first in the wire spaces situated within the continuous wire loop and then directly at the material web, that is, outside the wire loop.

The inventional ideas described so far can be further developed in various respects. For one, there are several possibilities of guiding the drying air into the wire spaces, for instance as fresh supply air. Next, there are several possibilities of sucking this drying air, as circulating air, again out of the wire spaces. Also the blowing of the circulating air directly at the material web and the reevacuation of this air can be performed by various methods. Lastly, another provision may be mixing the supply air with a variable part of the circulating air and/or enrich the circulating air with a variable amount of fresh supply air.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

DETAILED DESCRIPTION OF THE PREFERRED EMBODIMENT

Figure 1:
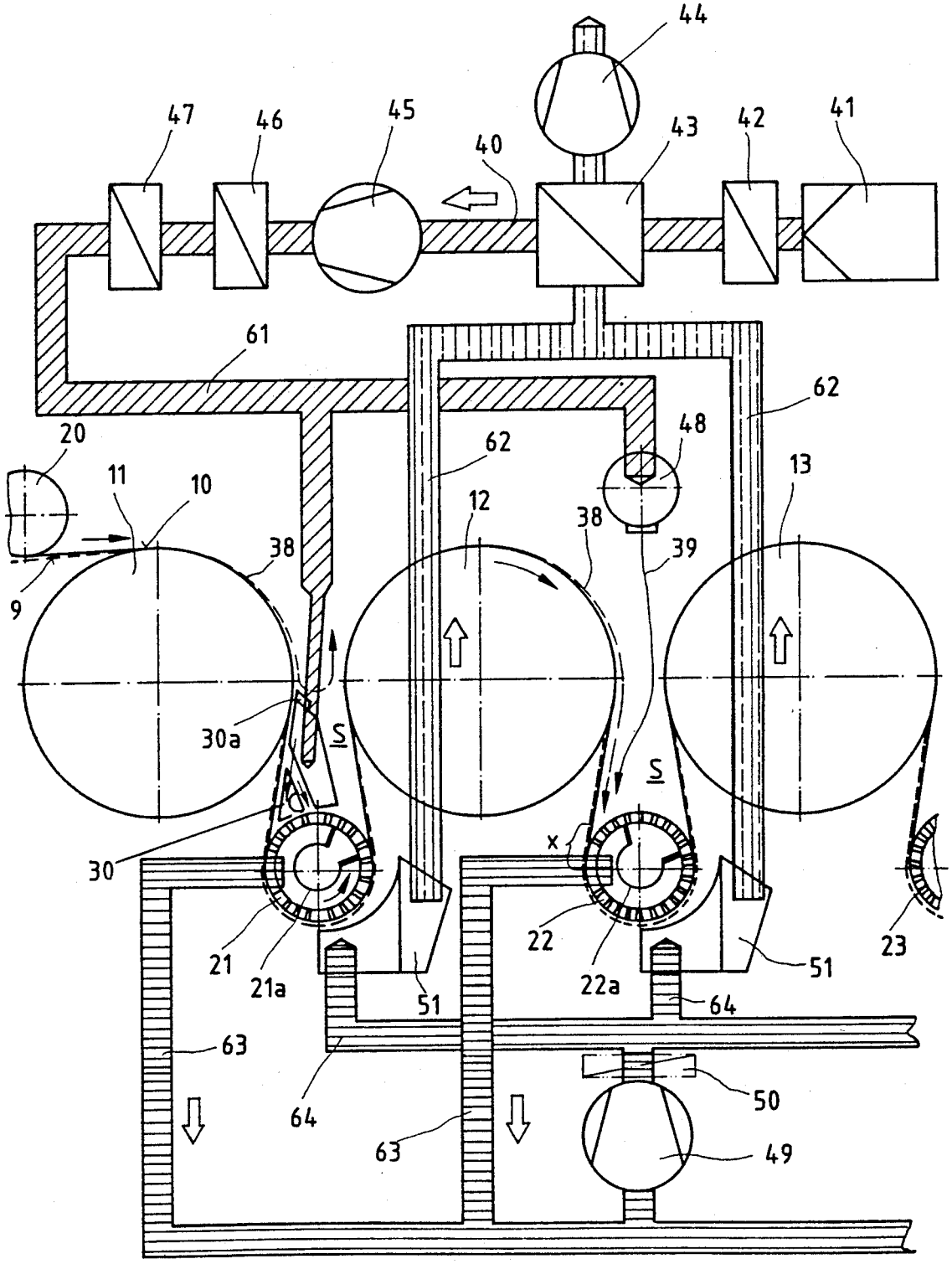
FIG. 1 shows an air handling schematic for a so-called single-wire drying group, for instance of a paper machine, with two different methods of air supply to the wire spaces.

Illustrated to FIG. 1 are a row of drying cylinders 11, 12 and 13 of a drying group. Located between each two drying cylinders is a suction guide roll 21 through 23. Another guide roll, located at the entrance to this drying group, is marked 20. The material web to be dried, for instance paper web 9, runs together with a continuous backing belt, for instance drying wire 10, successively and alternately across the drying cylinders 11 through 13 and across the suction guide rolls 21 through 23. The latter are situated within the continuous drying wire loop, whereas the drying cylinders are situated outside. Therefore, the paper web 9 makes direct contact with the drying cylinders 11 through 13. Contrarily, the drying wire 10 makes direct contact with the suction guide rolls 21 through 23. The interior of the suction guide rolls carries a vacuum causing the paper web to safely cling to the drying wire also at high web speeds. The space defined by two adjacent drying cylinders, for instance 12 and 13, and by the suction guide roll 122 contained in between, as well as by the drying screen 10, will hereafter be called "wire space" S.

The following explanations apply to all FIGS. 1 through 5: Each of the illustrated drying systems comprises three air line systems, namely:

1. Line system 61 for supply air; this is normally fresh drying air to be supplied to the drying group. The lines 61 of this system are provided in all figures with an oblique hatching.
2. Line system 62 for exhaust air; this is the drying air to be removed from the drying group after absorption of a maximum of water vapor. The lines 62 of the exhaust air line system are in all figures provided with a vertical hatching of solid and broken lines.
3. Line system 63, 64 or 63, 63*a*, 64 for circulating air; this is drying air which in the wire spaces S already has absorbed some water vapor, is sucked in there and blown at the paper web. The lines of this circulating air system are provided in all of the figures with a horizontal hatching.

The units to be provided, for example, for the handling and conditioning of the drying air are signified in all of the FIGS. 1 through 5 as follows:

41 Intake filter
42 Exhaust vapor condenser (used as needed)
43 Air/air heat exchanger
44 Exhaust air fan
45 Supply air fan with suction line 40
46 Condensate cooler (used as needed)
47 Supply air heater
48 Supply air blow pipes
49 Circulation air fan
50 Circulation air heater, to be provided as needed
51, 51', or 51" combined blow and suction boxes, also called "air guide boxes".

Illustrated in FIG. 1, in the area between the drying cylinders 12 and 13, is a first embodiment of the invention. A blow pipe 48 connected to the supply line 61 is provided there at the entrance to the wire space S. This pipe blows drying air into the wire space (arrow 39) in uniform distribution across the machine width. This drying air unites with the air boundary layer 38 which the drying wire 10 looping around the drying cylinder 12 carries into the wire space S. The drying air absorbs in the process already some water vapor. The two air flows 38 and 39 are then sucked out of the wire space S, by the suction guide roll 22, in uniform distribution across the machine width. The suction guide roll 22 features for that purpose a specially shaped suction box 22*a*. Its suction zone (as known from FIG. 8 of WO 88/06205) is on the approach side somewhat open toward the wire space S (presuction zone x). This avoids the paper web 9 from lifting off the drying wire at the point where the drying wire 10 runs on the roll 22.

A combined blow and suction box 51 is arranged in the area of the leaving side, lower quadrant of the suction guide roll 22. As will be explained in greater detail hereinafter, drying air is blown from this box directly at the paper web 9, which runs here on the outside of the drying wire 10 around the suction guide roll 22. The drying air absorbs water vapor here and is immediately thereafter sucked out through the exhaust line 62. With an increased spacing between the roll 22 and cylinder 13, a cylinder blow and suction box could be arranged further above the illustrated position.

Both in the wire space S and also in the combined blow and suction box 51, provisions are made that the supplied and removed air quantities will be extensively equal. This avoids transverse flows, ensuring especially that no air with absorbed water vapor will be forced outward sideways. In other words, this avoids contact of this moist air with the (not illustrated) machine frames, hood walls or similar. If any, a slight transverse flow in the direction inward from outside can be allowed.

As already explained above, it is especially favorable to reuse the air sucked in from the suction guide roll 22, through the line 63, as so-called circulation air. To that end, the circulation air is fed by the circulation air fan 49 through the line 64 to the combined blow and suction box 51. If desired, it may be heated further by means of an additional air heater 50.

FIG. 1 shows in the area between the cylinders 11 and 12 still another embodiment of the invention. A so-called web stabilizer 30 is arranged there in the screen space S, known for instance from the German patent disclosure 37 06 542 (=U.S. Pat. No. 4,856,205). A blow pipe 48 is not provided in this case. Instead, supply air is passed from the line 61 to the interior of the web stabilizer 30, which on its underside features a blow slot that extends essentially across the entire machine width. Its discharge direction is opposite to the direction of rotation of the roll shell of the suction guide roll 21. This generates between the web stabilizer 30 and the drying wire 10, on the side where the drying wire runs from the cylinder 11 to the suction guide roll 21, a vacuum that causes the paper web 9 to safely cling to the drying wire 10. This effect is reinforced by a strip **30*a* which deflects the boundary air layer 38'. The air discharged by the web stabilizer 30 is sucked out again by the suction guide roll 21. Its suction zone, toward the wire space S, is for that purpose increased more so than in the case of the suction guide roll 22. It may also be suitable to subject the entire roll circumference of the suction guide roll 21 to suction. In this case, the fixed suction box 21*a*** could be omitted. The removal of the air from the interior of the roll would occur here directly through a hollow roll journal (rotating with the roll shell). Prior drying devices feature on the blow slot side of the web stabilizer, instead of a suction guide roll, a smooth, nonvacuum guide roll or a drying cylinder. This gives rise to the risk that the blowing air discharging from the web stabilizer will escape sideways from the wire space, which may result in the disadvantages discussed previously.

Figure 2:
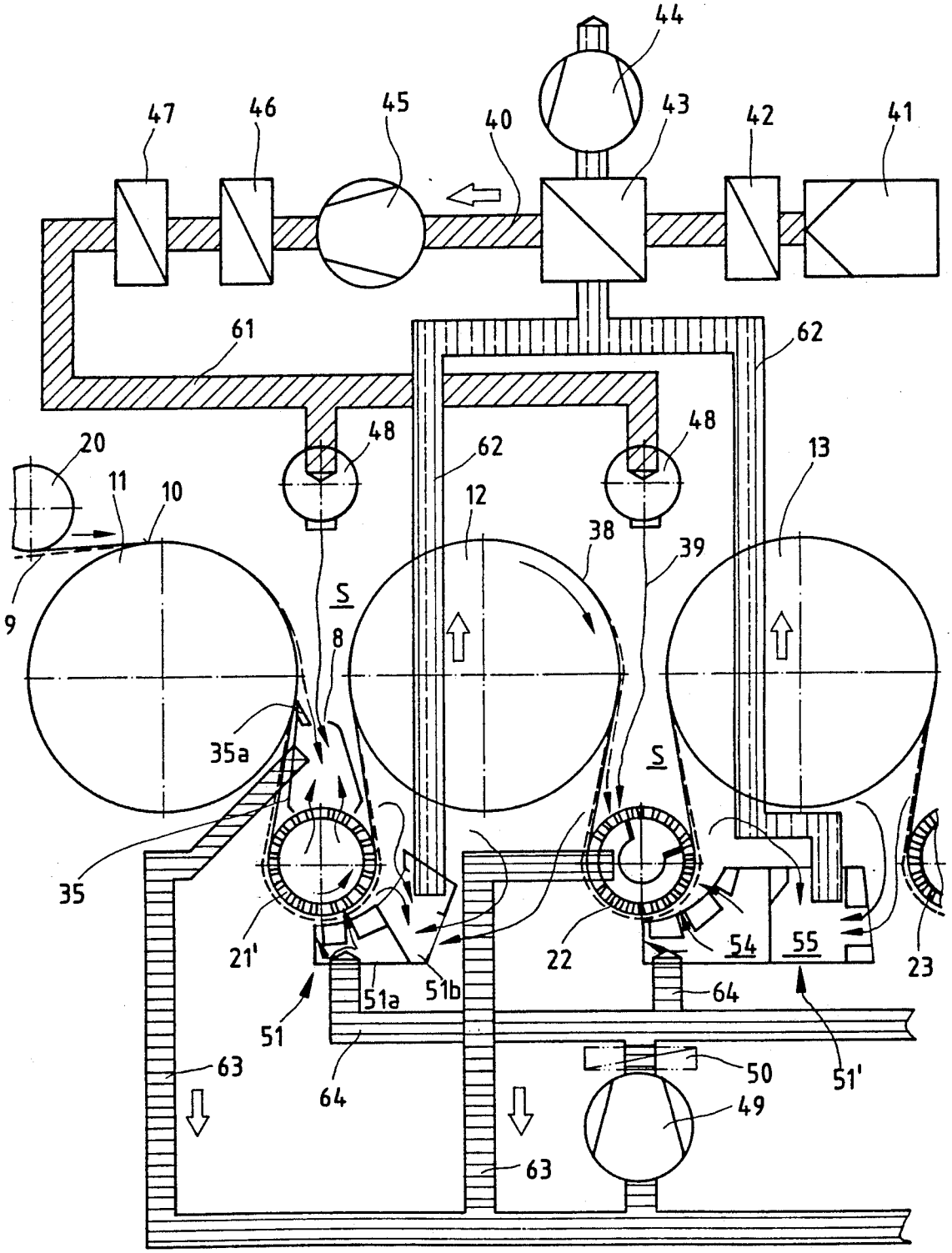
FIG. 2 shows several modifications of the embodiments according to FIG. 1.

In FIG. 2, the same air handling is provided between the drying cylinders 12 and 13 as between the cylinders 12 and 13 of FIG. 1. But in the wire space S between the cylinders 11 and 12 the following is now provided for: drying air is supplied through a blow pipe 48; insofar, no difference exists anymore from the other wire space between the cylinders 12 and 13. However, the removal of air from the wire space S occurs now by means of an external suction box 35. Connected for instance to the circulation line 63, this suction box is open toward the cylinder surface of the suction guide roll 21' and, thus, generates a vacuum inside the roll. The box walls diverge in the direction of web travel from the drying wire 10. The box also features a deflection strip **35*a* for the air boundary layer carried to the cylinder 11. The external suction box 35 thus acts at the same time as a web stabilizer. The special feature now is that it features directly beside the deflection strip 35*a* a row of suction openings 8** extending across the entire length of the box, through which the air boundary layer and the supplied drying air are removed.

Illustrated in FIG. 2 are several details of the combined blow and suction box, or "air guide box", 51 arranged on the suction guide roll 21'. These details apply also to FIG. 1. A blow chamber **51*a* connected to the circulation blow line 64 is visible. This chamber has two rows of blow slots through which drying air is blown directly at the paper web 9. Visible additionally is a suction chamber 51*b*, which in the direction of web travel is arranged behind the blow chamber 51*a*. The suction chamber 51*b* is connected to the exhaust air suction line 62** and has relatively large suction openings, which partly are arranged on the topside and partly on the bottomside.

A modified air guide box 51', in FIG. 2, is arranged below the drying cylinder 13. It extends (more so than the previously described air guide box 51) toward the following suction guide box 23. The blow chamber 54 again has several blow slots directed at the guide roll 22. The suction chamber 55 has again large suction openings for absorbing the clouds issuing from the paper web 9.

Figure 3:
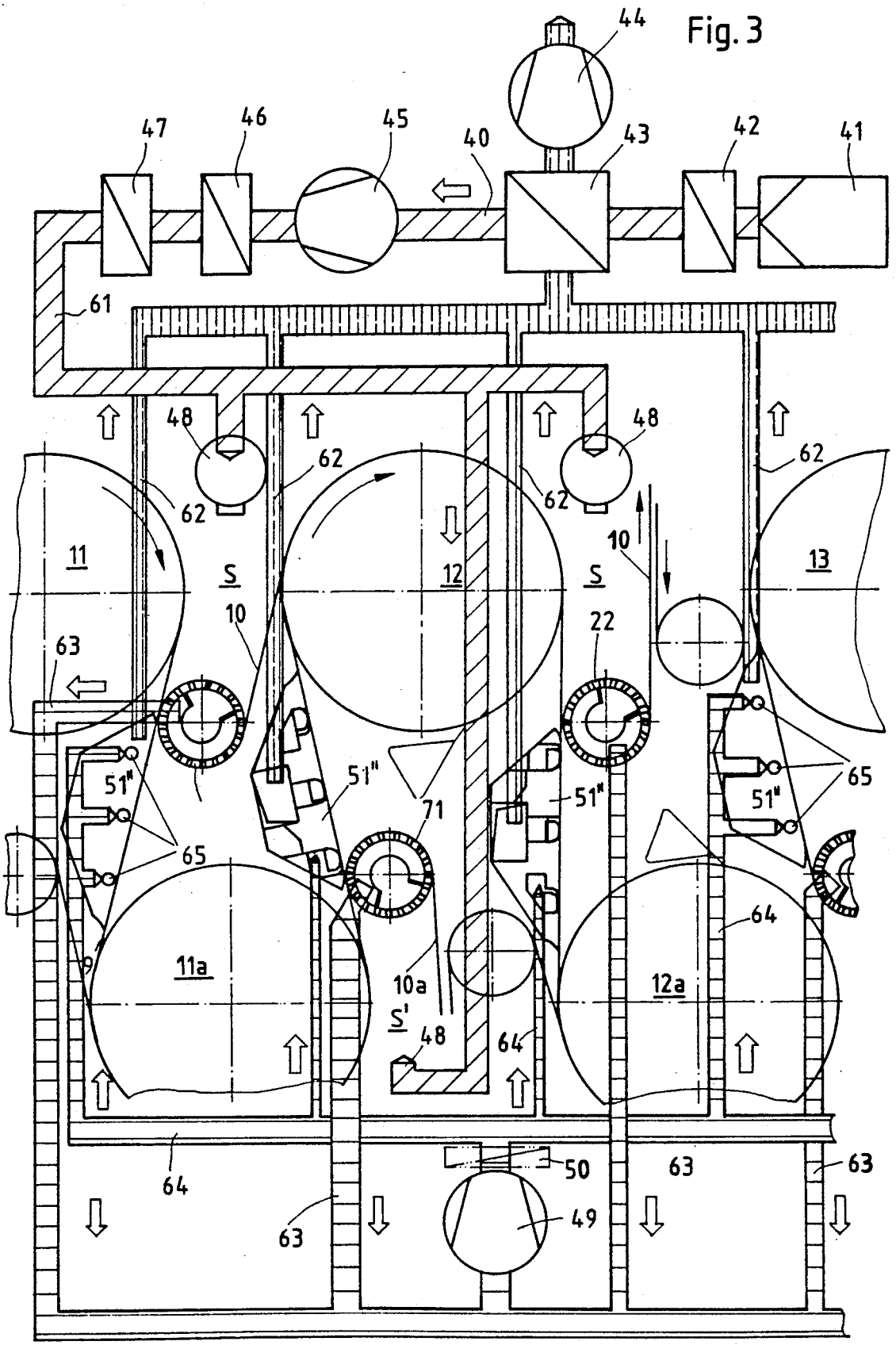
FIG. 3 shows an air handling diagram for a two-wire drying group of a paper machine.

In FIG. 3, similar to the case of the object of the initially mentioned patent application P 38 07 857.0, the paper web 9 meanders alternately across the drying cylinders 11, 12 and 13 of an upper cylinder row and across additional cylinders **11*a* and 12*a* of a lower cylinder row. An upper drying wire 10 forces the paper web onto the upper drying cylinders 11 and 12 and carries the paper web (the same as in FIGS. 1 and 2) from the cylinder 11 to the suction guide roll 21 and from the cylinder 12 to the suction guide roll 22. In variation from FIGS. 1 and 2, the paper web continues then without support by a drying wire from the suction guide roll 21 to the lower cylinder 11*a*. There, it is forced by a lower drying wire 10*a* to the cylinder shell, and then proceeds to an additional lower suction guide roll 71. From there it continues freely to the upper cylinder 12. Similarly, the paper web runs from the cylinder 12 across the cylinder 12*a* to the cylinder 13. Arranged at each of the free paper web trains is an air guide box 51'', which in detail is designed according to patent application P 38 07 857.0, and acts as a web stabilizer. According to the invention, each of these air guide boxes 51'' is now connected, for one, to a circulation pressure line 64 and, for another, to an exhaust suction line 62. Two of these air guide boxes 51'' are illustrated in cross section and two in side elevation, each with three schematically illustrated circulation air connections 65**.

In the interior of each of the air guide boxes 51'' the circulation air is fed to airfoil type nozzle elements which blow the air at the paper web and at the same time guide the web. Immediately behind each nozzle element, the air is removed again through an exhaust channel. Otherwise, the drying system illustrated in FIG. 3 corresponds to those of FIGS. 1 and 2. Supply air is again blown into the wire spaces S through the blow pipes 48 and sucked out of the suction guide rolls 21 and 22 by the circulation air fan 49. Additionally though, lower wire spaces are now provided, for instance on the lower wire guide roll 71 the wire space S', to which drying air is also supplied, as schematically illustrated by the line 48'. Circulation air is removed also from the lower suction guide roll 71 through one of the lines 63 and fed by the fan 49 into the pressure line network 64.

Figure 4:
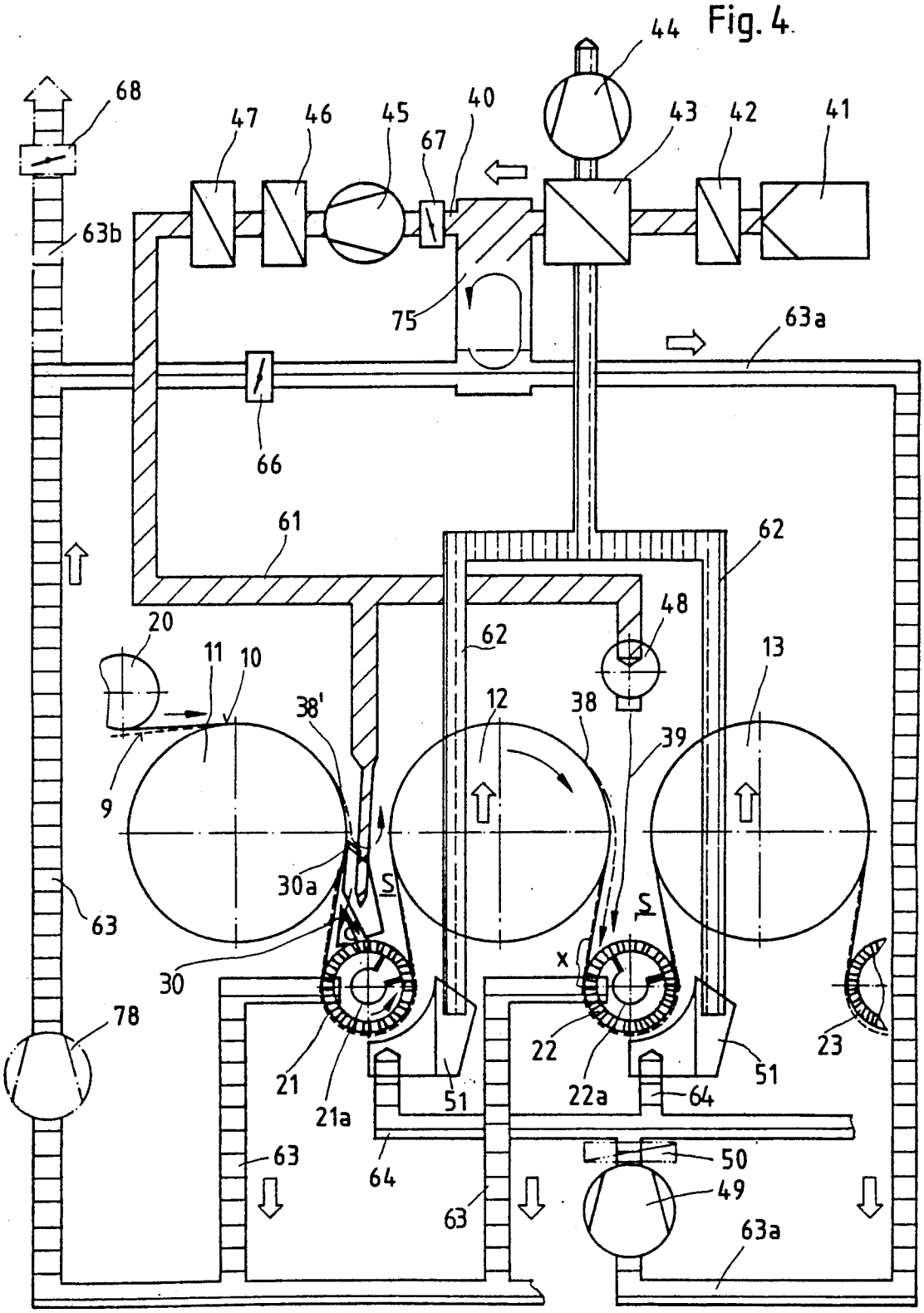
FIG. 4 and 5 shows further possible modifications of the illustrated in FIG. 1.

FIG. 4 differs from FIG. 1 by a modification of the line system 63, 64 for the circulation of air. The lines 63 coming from the suction guide rolls 21 and 22 carry the air not directly to the circulation air fan 49 but, by way of a butterfly valve 66, to a mixing chamber 75 and only from here 730 (line 63*a*) to the circulation air fan 49. Also the supply air coming from the heat exchanger 43 flows through the mixing chamber, proceeding then through the suction line 40 with butterfly valve 67 to the supply air fan 45. An additional circulation air fan 78 may be provided in the line 63. Between said fan and the butterfly valve 66, an exhaust fan 63*b* with butterfly valve 68 emptying in the open may be connected to line 63. In the mixing chamber 75, part of the supply air mixes continuously with part of the circulation air. Thus, part of the circulation air removed from the wire spaces S (and containing still little moisture) proceeds together with a part of fresh supply air back into the wire spaces. Also, it is now possible to feed to the air guide boxes 51 an air mixture that is somewhat drier than in FIG. 1. If in the suction guide rolls 21, 22 an especially high vacuum is required, a relatively large amount of air must be sucked out of these rolls, which may be larger than the circulation air required in the overall system. In this case, part of the removed circulation air can escape through the exhaust line 63*b*.

Figure 5:
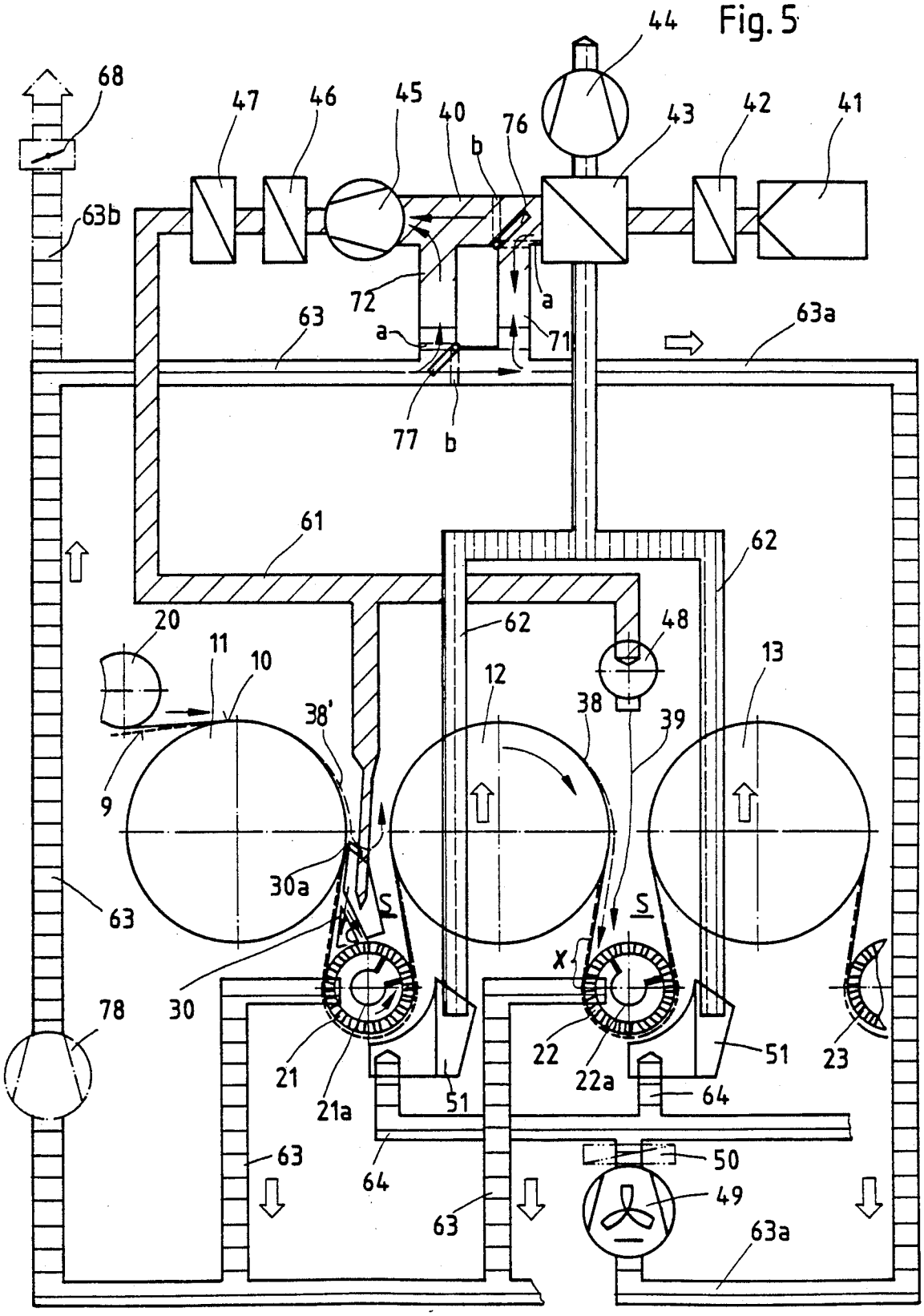

FIG. 5 differs from FIG. 4 only in that instead of the mixing chamber 75 there are two mixing lines 71 and 72 provided, both of which connect the suction line 40 with the circulation line 63/63*a*. A first mixing line 71 (relative to the flow direction in the suction line 40) has at the point where it branches off the suction line, a flow control flap 76 that splits the flow. This flap is able to assume any position between the limit positions a and b illustrated by broken lines. Thus, the approaching supply air can be divided at selective ratios and fed partly to the supply line 61 and partly to the circulation air line 63. A similar control flap 77 is provided on the intake of the second mixing line 72 to the circulation air line 63/63*a*. This flap, too, can be set to any desired position between two limit positions a and b. Thus, also the approaching circulation air can be split at desired ratios in a partial flow that returns to the supply line 61, and a partial flow proceeding to the suction line 63*a* of the circulation air fan 49. Thus, FIG. 5 provides more variation options than the design according to FIG. 4. For example, when both control flaps 76 and 77 are in the limit position a, no mixing takes place between supply air and circulation air; i.e., the same state prevails as in FIG. 1. With the control flaps in a center position, for instance in the position indicated by solid lines, mixed air proceeds into both lines 61 and 63, but at differently adjustable mixing ratios. A more unfavorable, but theoretically as well conceivable condition is given with both control flaps 76 and 77 in the limit position b. In this case, strictly supply air proceeds into the line 63*a* and strictly circulation air returns to the line 61. Conceivable are still other operating conditions. For instance, one of the two control flaps 76 and 77 may be set to a center position and the other control flap to one of the limit positions a or b.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for drying a material web running through said device, comprising:

a plurality of heatable drying cylinders arranged in a row and having a respective suction guide roll positioned between each pair of adjacent cylinders of said plurality of drying cylinders, each of said suction guide rolls including a suction device, each of said drying cylinders being in contact with said material web as the web runs along a path through said device;

a porous backing belt running through said device together with said material web and forcing said web onto said drying cylinders, said porous backing belt being in contact with said suction guide rolls as said belt runs through said device, wherein each pair of adjacent drying cylinders, the suction guide roll positioned between each pair of adjacent drying cylinders and said backing belt define a wire space therebetween;

a respective air guide box positioned along said path between each pair of adjacent cylinders of said plurality of drying cylinders for feeding drying air directly at said material web by means of a fan having a suction line;

a respective blow box coordinated with each of said wire spaces, each said blow box extending crosswise through said drying device and having at least one row of blowing air orifices extending across the length of said box and directed into said wire space;

wherein said suction line of said fan is in communication with said suction device of said suction guide roll by means of a circulation air line.

2. A device as described in claim 1, wherein each said blow box is arranged in an area where said material web is in contact with respective adjacent drying cylinders.

3. A device as described in claim 1, including a web stabilizer for sucking said material web onto said porous backing belt as said web runs from a drying cylinder to a suction guide roll following said cylinder, wherein said web stabilizer assumes the function of said blow box.

4. A device as described in claim 1, in which an external suction box coordinated with said suction guide roll is arranged in said wire space, said external suction box having an interior, wherein said interior communicates with said wire space by way of suction openings.

5. A device as described in claim 3, in which an external suction box coordinated with said suction guide roll is arranged in said wire space, said external suction box having an interior, wherein said interior communicates with said wire space by way of suction openings.

6. A device as described in claim 1, in which said material web and said porous backing belt continuously run, alternately, across respective drying cylinders and suction guide rolls, wherein each said air guide box is arranged in an area where said backing belt and said material web run across said suction guide roll.

7. A device as described in claim 4, in which said material web and said porous backing belt continuously run, alternately, across respective drying cylinders and suction guide rolls, wherein said air guide box is arranged in an area where said backing belt and said material web run across said suction guide roll.

8. A device as described in claim 6, in which said air guide box is divided into a blow chamber and a suction chamber, said suction chamber having suction openings for removal of drying air laden with water vapor, wherein when viewed in longitudinal section through said drying device and in cross section through said air guide box, said air guide box extends along a web-free portion of one of said drying cylinders; wherein said blow chamber is coordinated with one of said suction guide rolls positioned on an approach side of said cylinder; and wherein said suction chamber is coordinated with one of said suction guide rolls positioned on a leaving side of said cylinder.

9. A device as described in claim 1, said device including upper and lower drying cylinders and upper and lower backing belts, wherein said material web meanders alternately across said upper drying cylinders and said lower drying cylinders and is forced by said upper backing belt onto said upper drying cylinders and by said lower backing belt onto said lower drying cylinders, said respective air guide boxes being arranged at respective positions where said material web proceeds as a free train from a suction guide roll to a drying cylinder immediately following said suction guide roll.

10. A device as described in claim 1, wherein an air heater is positioned between said fan and said air guide box.

11. A device as described in claim 3, wherein an air heater is positioned between said fan and said air guide box.

12. A device as described in claim 4, wherein an air heater is positioned between said fan and said air guide box.

13. A device as described in claim 1, including a line for feeding drying air to said respective blow boxes, wherein said line communicates with said suction line via a mixing chamber.

14. A device as described in claim 1, including a line for feeding drying air to said respective blow boxes, wherein said line communicates with said suction line via a mixing line having a flow control flap.

15. A device as described in claim 14, in which said flow control flap is fashioned as a flow splitter, wherein said flow splitter divides said supplied drying air.

16. A device as described in claim 14, in which said drying air in said line is fed to said respective blow boxes in a specified flow direction, and wherein with regard to said flow direction there is provided behind said mixing line a second mixing line having a second flow control flap, which second mixing line connects said line with said circulation air line.

17. A device as described in claim 15, in which said drying air in said line is fed to said respective blow boxes in a specified flow direction, and wherein with regard to said flow direction there is provided behind said mixing line a second mixing line having a second flow control flap, which second mixing line connects said line with said circulation air line.

18. A device as described in claim 16, in which said second flow control flap is fashioned as a flow splitter, wherein said flow splitter divides said circulation air supplied through said circulation air line.

19. A device as described in claim 17, in which said second flow control flap is fashioned as a flow splitter, wherein said flow splitter divides said circulation air supplied through said circulation air line.

20. A device as described in claim 13, wherein in said circulation air line an additional air circulation fan is provided before said mixing chamber.

21. A device as described in claim 14, wherein in said circulation air line an additional air circulation fan is provided before said mixing line.

22. A device as described in claim 16, wherein in said circulation air line an additional air circulation fan is provided before said mixing lines.

23. A device as described in claim 20, wherein an exhaust line provided with a flow control flap is provided between said additional air circulation fan and said mixing chamber.

24. A device as described in claim 21, wherein an exhaust line provided with a flow control flap is provided between said additional air circulation fan and said mixing line.

25. A device as described in claim 22, wherein an exhaust line provided with a flow control flap is provided between said additional air circulation fan and said mixing lines.

* * * * *